US005779087A

United States Patent [19]

Sharpe et al.

[11] Patent Number: 5,779,087

[45] Date of Patent: Jul. 14, 1998

[54] CLOSING TAB

[76] Inventors: Andrew J. Sharpe, 2 New Castle St., Concord, N.H. 03301-2209; Darryl J. Baker, 3 Greenwich St., Concord, N.H. 03301

[21] Appl. No.: 659,266

[22] Filed: Jun. 6, 1996

[51] Int. Cl.[6] ..... B65D 41/32

[52] U.S. Cl. ..... 220/269; 220/258; 220/336

[58] Field of Search ..... 220/212, 254, 220/258, 259, 269, 336, 729, 730, 731, 906

[56] References Cited

U.S. PATENT DOCUMENTS

| | | | |
|---|---|---|---|
| 4,442,950 | 4/1984 | Wilson | 220/269 |
| 4,511,057 | 4/1985 | Tontarelli . | |
| 4,580,629 | 4/1986 | LaBarge et al. . | |
| 4,605,141 | 8/1986 | Won | 220/269 |
| 4,648,528 | 3/1987 | LaBarge et al. . | |
| 4,834,258 | 5/1989 | Root | 220/269 |
| 4,887,712 | 12/1989 | Wells | 206/269 |
| 4,948,008 | 8/1990 | Wu et al. . | |
| 4,979,635 | 12/1990 | Levine | 220/269 |
| 5,080,249 | 1/1992 | Shock | 220/269 |
| 5,121,851 | 6/1992 | Lyon et al. . | |

*Primary Examiner*—Stephen Cronin

[57] ABSTRACT

An improved can closure device for the closing of easy-open metal can end walls including: a one piece closing tab having a central body, circumferential flange, annular sealing ring, semi-annular locking ring, semi-annular locking channel, tab opening strip, and a hole for attachment to a can end wall; an improved metal opening tab; an elongated attaching post/rivet; and a sealing channel provided in the sheet metal can end wall. The closing tab is co-mounted with and beneath the improved metal opening tab and minimally impacts the can opening function of the metal opening tab. The consumer opens the can in much the same way as he or she now does by using the existing metal opening tab. After the can is opened, the closing tab is rotated approximately 180 degrees, aligned with the can opening, and pushed downwardly into place to close the can, thus preventing loss of contents due to spillage, providing protection of the contents from dirt, sand, or insects, and retarding loss of carbonation. Improvements to the metal opening tab and the attaching post/rivet are required to accomodate the closing tab. These improvements consist of a downward enlargement of the side wall on the lever end of the metal opening tab, an elongation of the attaching post/rivet, and the provision of an annular sealing channel provided in the metal can end wall. Other than the aforesaid improvements, the metal can end wall and it's attachment to the can side wall are similar to that in common use today.

10 Claims, 6 Drawing Sheets

CLOSING TAB

BACKGROUND

1. Field of Invention

This invention relates to easy-open beverage containers, specifically to an improved method of closing these containers.

2. Description of Prior Art

The easy-open metal beverage container, or can, is a common and very popular means of storing and distributing both carbonated and non-carbonated beverages. However, the easy-open can is loosing market share as more and more consumers are switching to threaded cap type containers. Informal surveys indicate that the purchasing preferences of a substantial segment of the can buying population has shifted, and continues to shift, away from the conventional easy-open beverage container in favor of recloseable threaded glass or plastic containers. This shift is occurring despite the numerous advantages of cans such as low bottling and container costs, efficient use of shelf, storage, and shipping space (herein after referred to as can stackability), less breakage compared with glass, and longer shelf life compared with plastic bottles. One important reason for this shift away from metal cans is the lack of an economical, and easy to use device to close the can after it has been opened.

Early attempts to provide a device and method to close easy-open cans required the purchase and use of an after market device such as that disclosed in U.S. Pat. No. 4,511,057 to Tontarelli (1985). While these types of devices did provide a means of closing metal beverage containers, they required the consumer to purchase an additional item. They also required cleaning and storage after each use and were inconvenient to use. A closing device which was integral to the container was needed.

Several types of integral closing devices have been disclosed in prior patents. One type of device required the fabrication of a formed spout integral with the can end wall, a digitally depressed opening panel located within the mouth of the spout and defined by an arcuate scoreline, and an overlying cap. An example of this type of device is disclosed in U.S. Pat. Nos. 4,580,692 (1986) and 4,648,528 (1987) both to LaBarge and Heffner, as well as 5,121,851 to Lyon et al. (1992). Although capable of providing a liquid and gas tight seal, such closing devices were expensive to manufacture, would "balloon" outwardly from the opening as pressure built up inside the closed can, were cumbersome to use, required great digital strength to rupture the opening panel, could cause the consumers' fingers to come in contact with the contents of the can as well as potentially sharp metal pieces, and were not accepted by the industry, as evidenced by their lack of market presence.

A second type of device is disclosed in U.S. Pat. No. 4,948,008 to Wu et al. (1990). This device included a plug type closure which was attached to the opening panel of the can. To open the container, the consumer would pull upwardly on the plug-opening-panel assembly separating it from the can. To seal the container, the consumer would remove the opening panel from the plug, invert the plug, and insert it into the opening left in the can end wall after removal of the plug-opening-panel assembly. This device also was inconvenient to use, interfered with can stackability, exposed the consumer to potentially sharp metal pieces, and left the consumer with a loose piece of metal from the plug-opening-panel assembly which then had to be disposed. This device also has not gained acceptance in the market place.

A third type of device is disclosed in U.S. Pat. No. 5,080,249 to Shock (1992). This device was a modification of the common metal pull tab and consisted of a ring shaped pull ring and a cover portion. The pull ring was used to rupture the scoreline defined opening panel. The cover portion could then be rotated over the opening to close the container. The rigidity of the pull tab caused a biasing of the cover portion toward the can end wall such that it would cover and close the can opening. While easy to use, this closing device did not provide a positive method to secure it in position over the hole. It also has not gained acceptance in the market place.

All of the easy open beverage can closing devices heretofore known suffer from one or more of the following disadvantages:

(a) Their manufacture required significant retooling of existing equipment at great cost and effort.

(b) Significant changes in the construction and manufacture of existing beverage containers was required.

(c) These closures were cumbersome and inconvenient for the consumer to use and involved considerable digital strength to effectuate opening of the can.

(d) The consumer safety and sanitary aspects of the closures were questionable. The patents issued to La Barge and Heffner (1986) and (1987) as well as to Lyon et al. (1992) involved the use of direct digital pressure upon an opening panel to rupture the panel along an arcuate scoreline. Thus, not only was great digital strength required to open the can, the consumer also was exposed to possible injury from either the force required to open the can, or their fingers possibly coming into direct contact with the sharp edges of the can. Also, the consumer's fingers could come in contact with the contained liquid. The patents to Wu et al. (1990) and Tontarelli (1985) also raise consumer safety and sanitary questions as they involved the use of a separable and a separate piece respectively, to effectuate closing of the can. The separable piece in the patent of Wu et al. (1990) could pose a safety hazard from accidental ingestion if not properly disposed. The separate piece in the patent of Tontarelli (1985) could pose a health problem if not properly washed in between uses.

(e) A positive means of securing the closing device within the opening in the can end wall was not provided.

(f) The efficient use of shelf, storage, and shipping space was negatively impacted by the known devices due to their interference with the bottom of an identical can when stacked directly on top of each other.

OBJECTS AND ADVANTAGES

Accordingly, several objects and advantages of the present invention are:

(a) to provide a beverage container closing device which can be produced cheaply, (b) to provide a beverage container closing device which minimally impacts existing can construction and manufacturing methods;

(c) to provide a beverage container closing device which is convenient to use;

(d) to provide a beverage container closing device which provides for consumer safety by not requiring the consumer to apply digital force directly to the opening panel to effectuate opening, by not creating a situation where the consumer's fingers will come into contact with either the sharp edges of the can or the contents of the can as a necessary consequence of opening and closing the can, and by not creating a condition where the opening panel could be ingested by the consumer.

(e) to provide a beverage container closing device which has a positive means to secure it within the opening used to dispense the contents of the container; and (f) to provide a beverage container closing device which does not interfere with present can stackability, thus preserving the efficient use of can storage, shipping, and shelf space.

Further objects and advantages of our invention will become apparent from a consideration of the drawings and ensuing description.

Reference Numerals In Drawings

Figure 1:
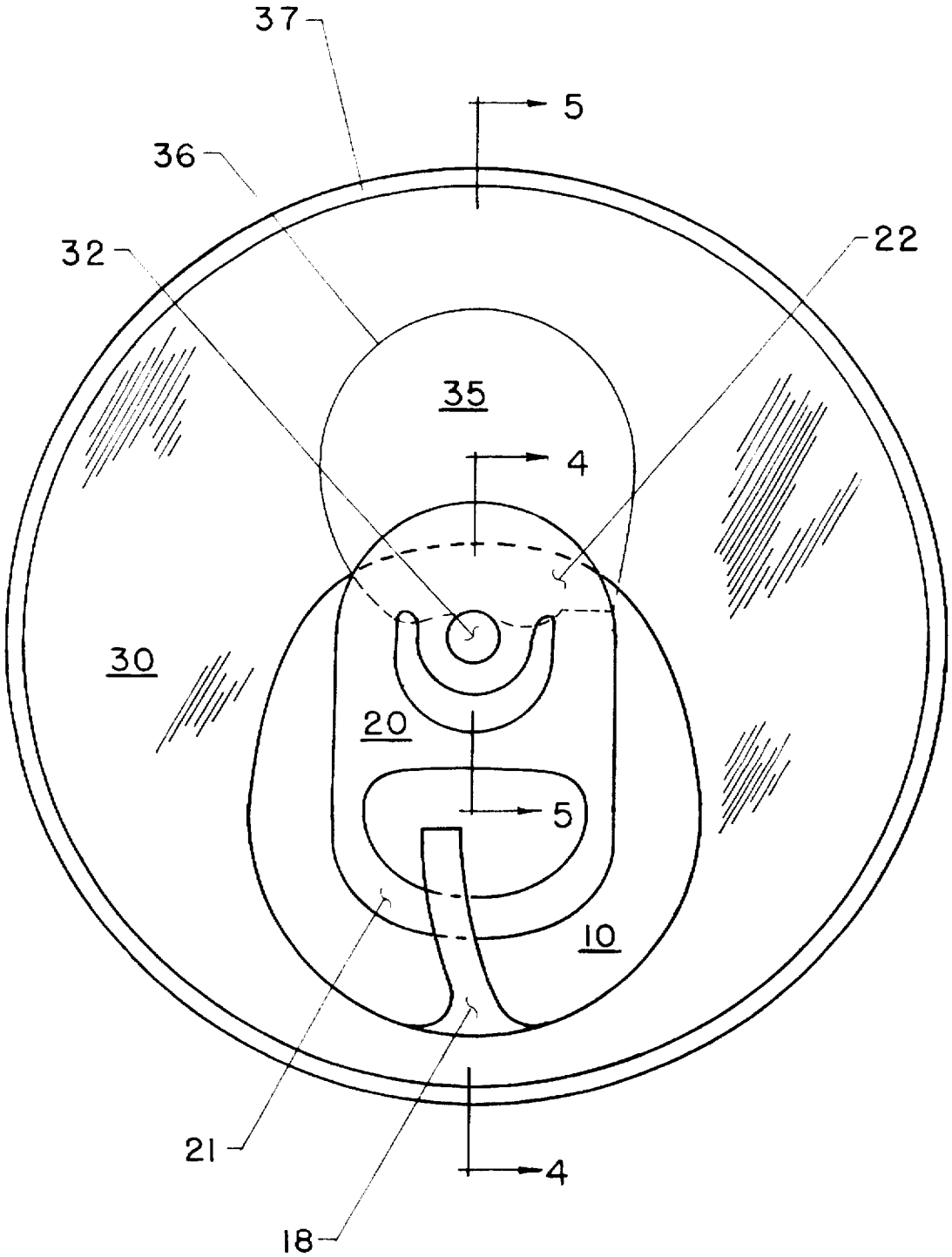
FIG. 1 is a general plan view depicting a can end wall with a closing tab co-mounted with and beneath a metal opening tab in the shipping/can-opening position.

| | | |
|---|---|---|
| 10 closing tab | 11 circumferential flange | 12 annular sealing ring |
| 14 semi-annular locking ring | 15 hole | 16 beveled edge |
| 17 semi-annular locking channel | 18 tab opening strip | 19 central body |
| 20 metal opening tab | 21 handle end | 22 lever end |
| 23 downward enlargement | 24 side wall | 25 semi-circular metal projection |
| 30 can end wall | 31 annular sealing channel | 32 attaching post/rivet |
| 33 top flange | 35 opening panel | 36 arcuate scoreline |
| 37 double seam joint | 38 can body | 40 can bottom (portion) |
| 10' reference point | | |

SUMMARY OF THE INVENTION

This invention is described as a one piece closing tab co-mounted with and beneath a metal opening tab to effectuate closing of an easy-open can end wall. In it's broadest sense, the present invention consists of a single piece of rigid elastically deformable material co-mounted with, and beneath, a metal opening tab similar to those commonly found on easy-open cans. It includes:

a) A central body of predetermined shape and size sufficient to include a hole for attaching it to the can end wall and to completely and exactly cover an opening in a metal can end wall resulting from the rupture of an opening panel defined by an arcuate scoreline;

b) A semi-annular locking ring located on the underside of the central body for the purpose of securing the closing tab in position by snapping into place when pushed into the opening in the can end wall;

c) A circumferential flange projecting outwardly from the central body of the closing tab;

d) An annular sealing ring located on the underside of the circumferential flange;

e) A matching annular sealing channel provided in the can end wall; and f) A ribbon-like extension of the closing tab for removing the closing tab from the opening in the can end wall when the consumer desires to dispense the material contained within the can body.

Together the above components, either in total or in part, constitute the closing tab of this invention. The above components are described further in the section entitled "Detailed Description of the Drawings".

Also included are improvements to the metal opening tab and the can end wall necessary to accomodate the closing tab. These improvements comprise a downward enlargement of the lever end of the metal opening tab which comes in contact with the opening panel of the can, an elongation of the attaching post/rivet, and the provision of a sealing channel in the can end wall.

DETAILED DESCRIPTION OF THE DRAWINGS

Where the words "under", "top", "outwardly", "inwardly" or other like descriptors are used herein, they refer to a conventional easy-open can standing in an upright position with the opening can end wall located on the top. The words "attaching post/rivet" as used herein shall mean the protuberance which is stamped into the sheet metal can end wall for the purpose of rotationally attaching the metal opening tab to the can end wall and which is then deformed to form a flange which secures the metal opening tab in position and enables it to be used to rupture the opening panel along the arcuate score line in the can end wall.

Figure 4:
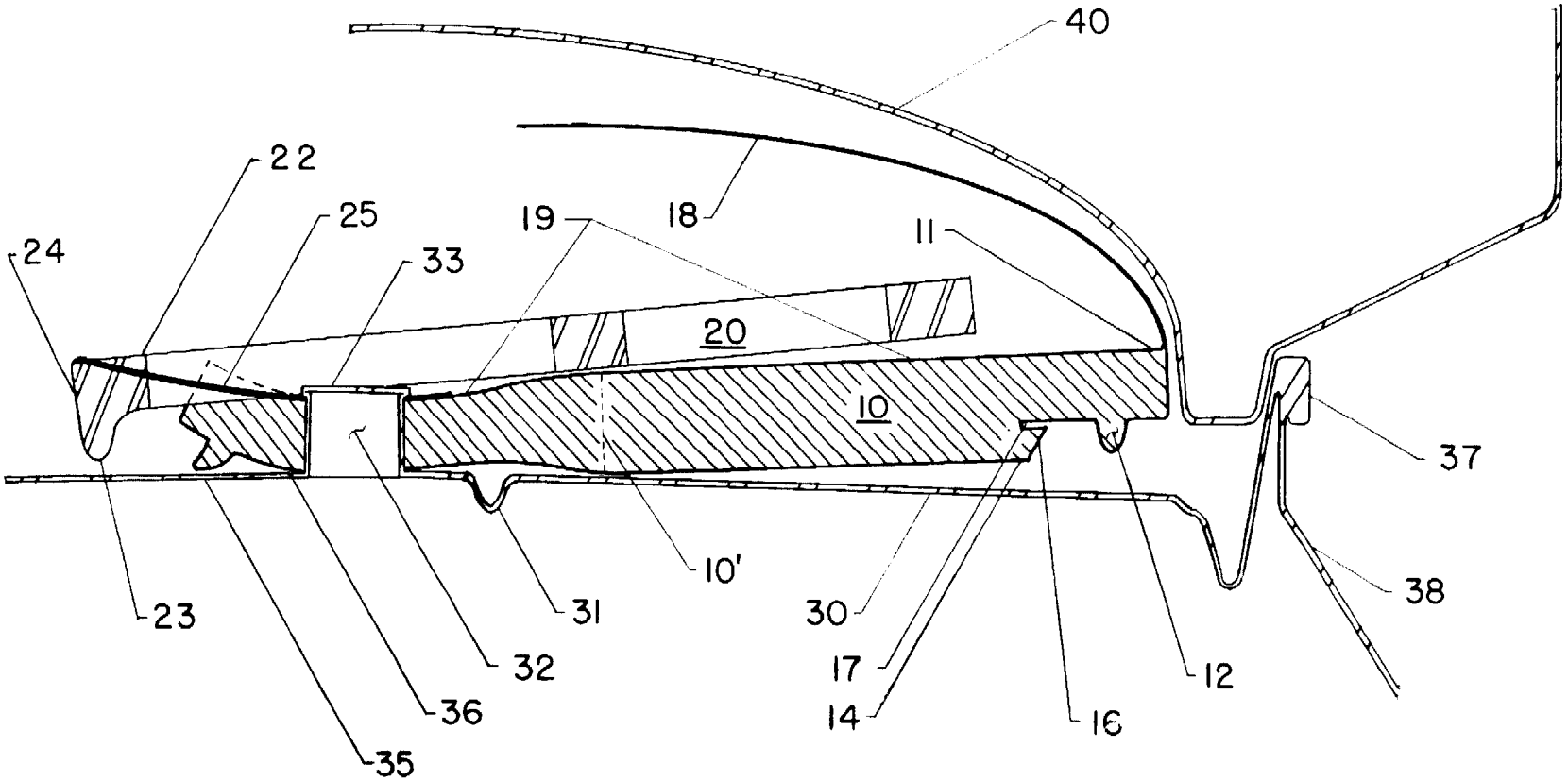
FIG. 4 is an enlarged sectional view taken along line 4—4, as shown in FIG. 1, depicting a closing tab in the shipping/can-opening position. Also depicted is a bottom portion of an identical can stacked on top of the shown can demonstrating absence of interference between a closing tab and a bottom of an identical can, thus preserving can stackability.
Figure 5:
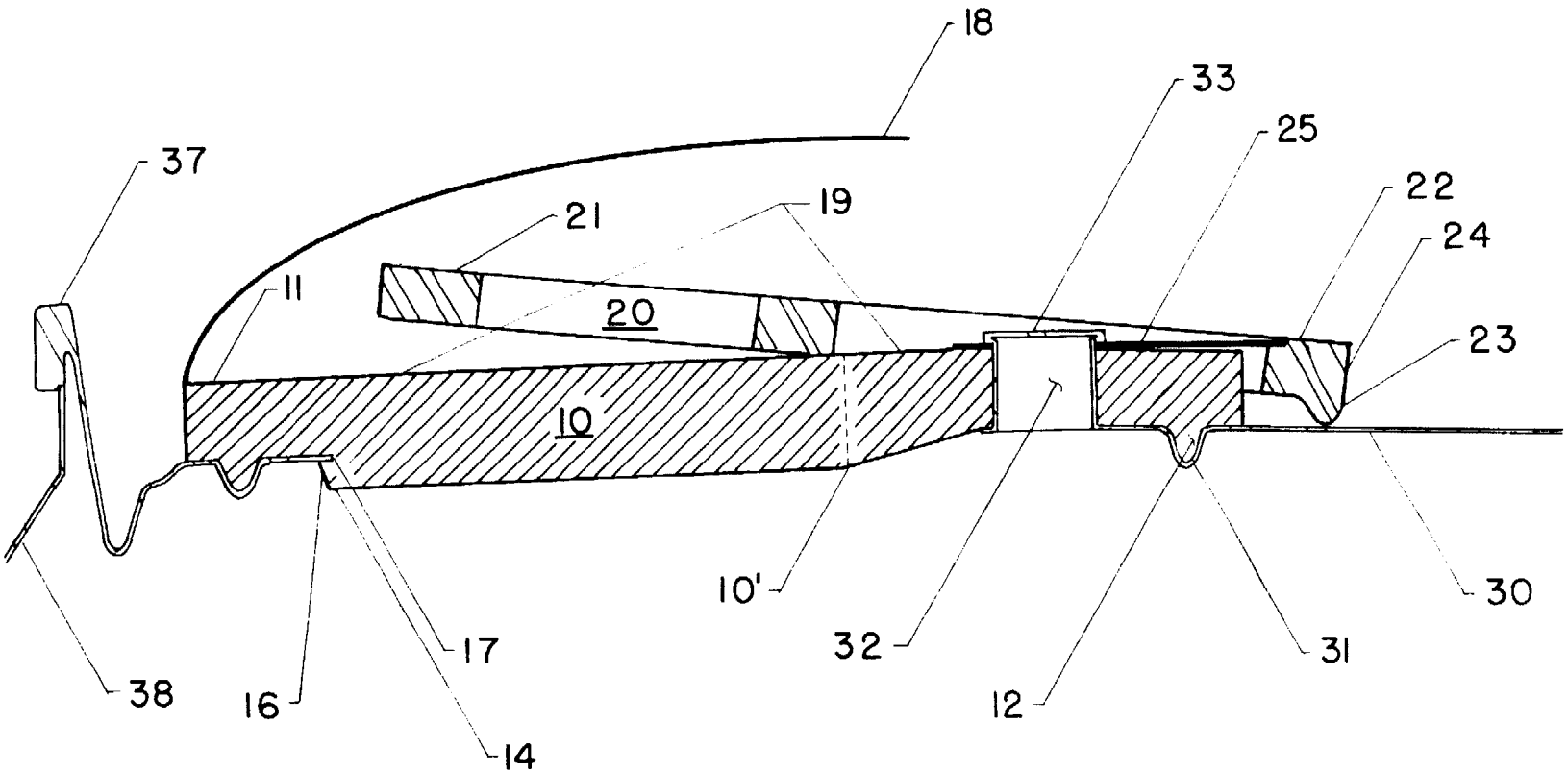
FIG. 5 is an enlarged sectional view taken along line 5—5, as shown in FIG. 1 depicting a closing tab in the can closing position.

FIG. 1 depicts a closing tab 10 of predetermined size, shape, and thickness, a metal opening tab 20, a can end wall 30, and a double seam joint 37 joining can end wall 30 with a can body 38 (omitted in FIG. 1 for clarity but shown in FIGS. 4 and 5). Closing tab 10 and metal opening tab 20 are shown in the shipping/can-opening position. A handle end 21, and a lever end 22 of metal opening tab 20 are also depicted, as well as an attaching post/rivet 32, an opening panel 35, an arcuate scoreline 36, and a tab opening strip 18. Tab opening strip 18 projects from the top outward side of said closing tab 10 at a point directly opposite the point of attachment of closing tab 10 to attaching post/rivet 32. In the preferred embodiment, closing tab 10 is made from a rigid elastically deformable material approved by the appropriate governmental agencies for use in food containers. These materials are commonly available and not listed herein.

Figure 2:
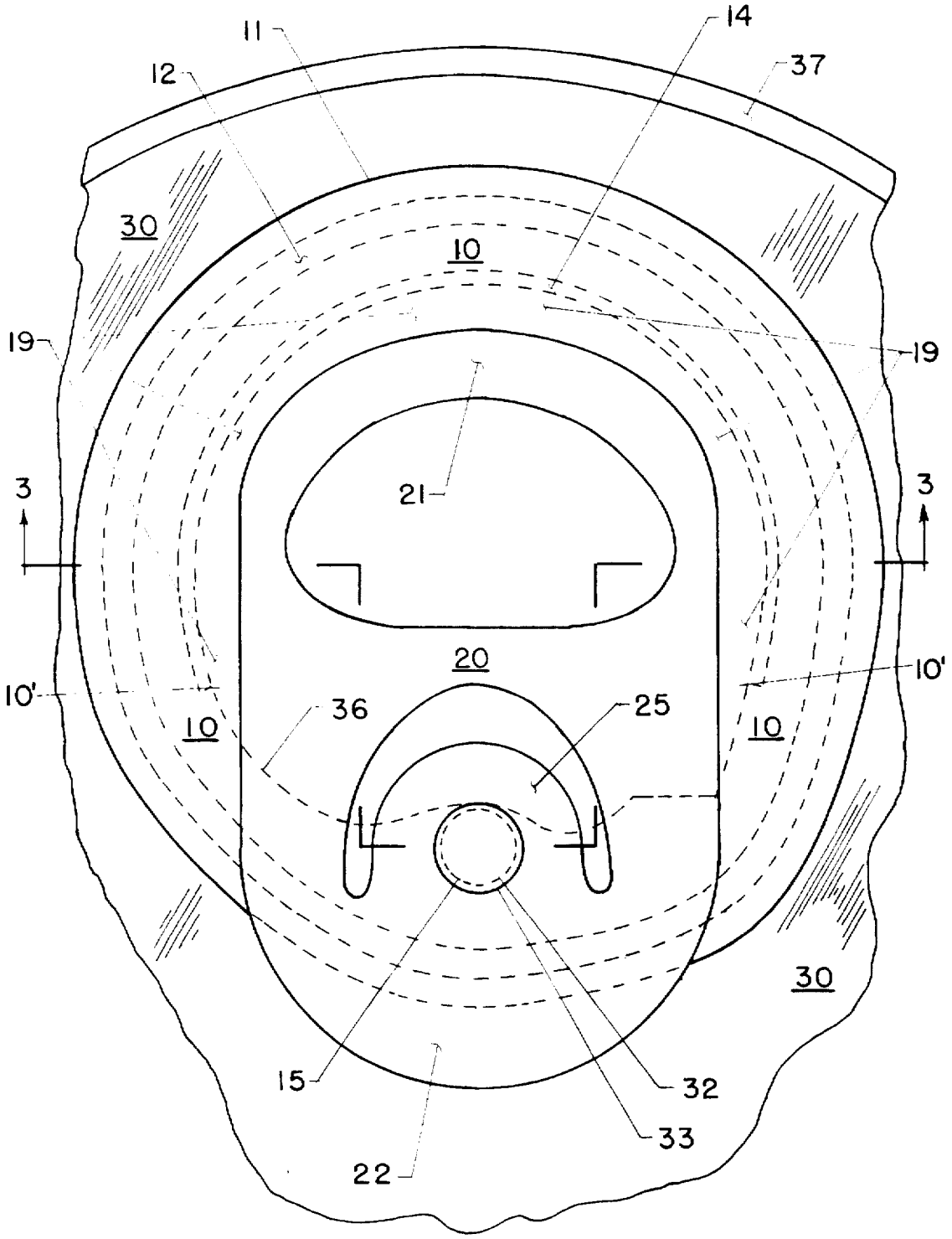
FIG. 2 is an enlarged plan view of a closing tab co-mounted with and beneath a metal opening tab in the can closing position. The closing tab has been rotated approximately 180 degrees from the position depicted in FIG. 1.
Figure 3:
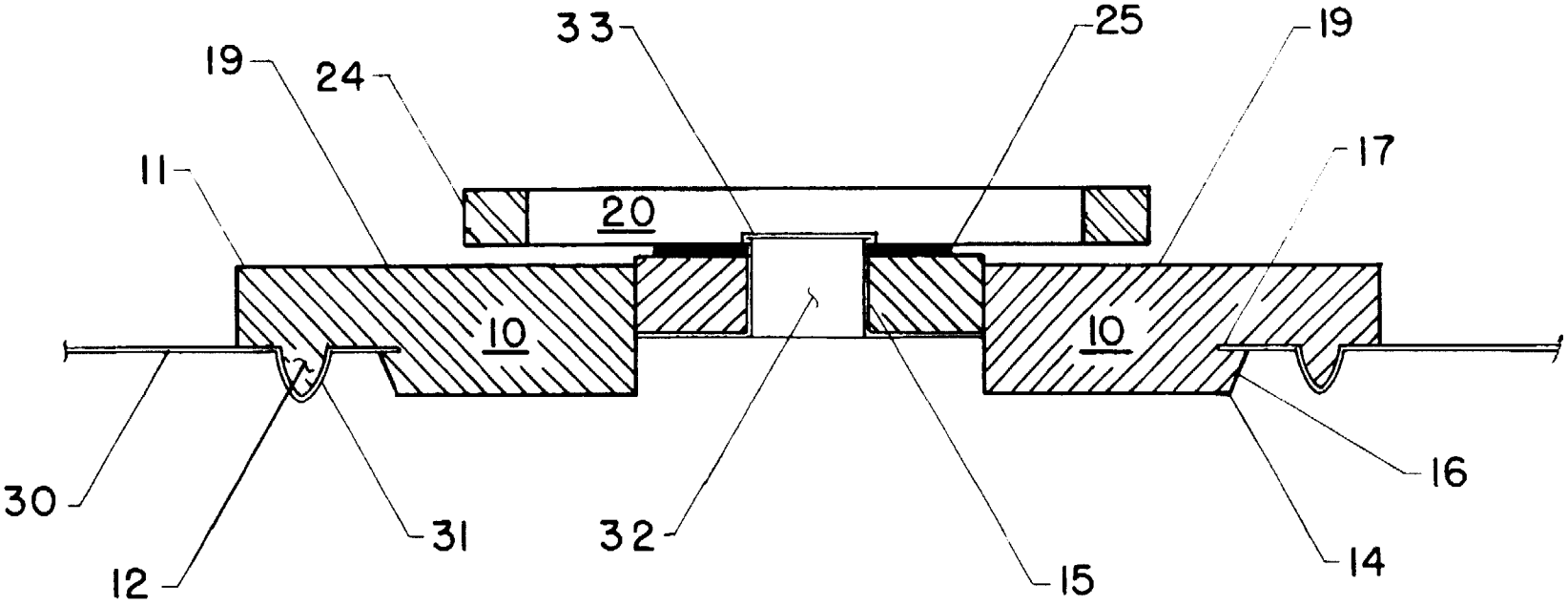
FIG. 3 is an enlarged sectional view depicting a closing tab and it's component parts, a metal opening tab, and a can end wall. The closing tab is shown in the can closing position taken along line 3—3 as shown in FIG. 2.

FIGS. 2 and 3 are enlarged plan and section views, respectively, of closing tab 10, metal opening tab 20, and can end wall 30. A circumferential flange 11, an annular sealing ring 12, a semi-annular locking ring 14, and a semi-annular locking channel 17 of closing tab 10 are depicted. Also shown are a matching annular sealing channel 31, and attaching post/rivet 32 with an integral top flange 33 of can end wall 30. Closing tab 10 is provided with a hole 15 which has a diameter equal to the outside diameter of attaching post/rivet 32.

Closing tab 10 has a central body 19 of predetermined size, shape, and thickness so as to include hole 15, to completely and exactly cover the opening in can end wall 30 resulting from rupture of opening panel 35, and be equal in thickness to circumferential flange 11. Projecting outwardly from central body 19 is circumferential flange 11. Projecting downwardly from circumferential flange 11 is annular sealing ring 12. When closing tab 10 is in the can closing position, annular sealing ring 12 will fully mesh with annular sealing channel 31 provided in can end wall 30.

In an alternative embodiment of our invention, circumferential flange 11, annular sealing ring 12, and annular sealing channel 31 are omitted inorder to minimize retooling and manufacturing costs. In a second alternative embodiment, annular sealing ring 12, and annular sealing channel 31 are omitted inorder to minimize retooling and manufacturing costs.

Projecting downwardly from central body 19 of closing tab 10 is semi-annular locking ring 14. Semi-annular locking ring 14 has a beveled edge 16, and semi-annular locking channel 17. Semi-annular locking channel 17 resembles a horse shoe with the open end oriented toward the center of can end wall 30 and the point of attachment of closing tab 10 to attaching post/rivet 32. Semi-annular locking ring 14 covers approximately 230 degrees of arc. The remaining 130 degrees of arc, ie. the open end of the horse shoe, do not have a locking ring. The function of semi-annular locking ring 14 and semi-annular locking channel 17 is to securely position and firmly hold closing tab 10 within the opening in can end wall 30.

Figure 3A:
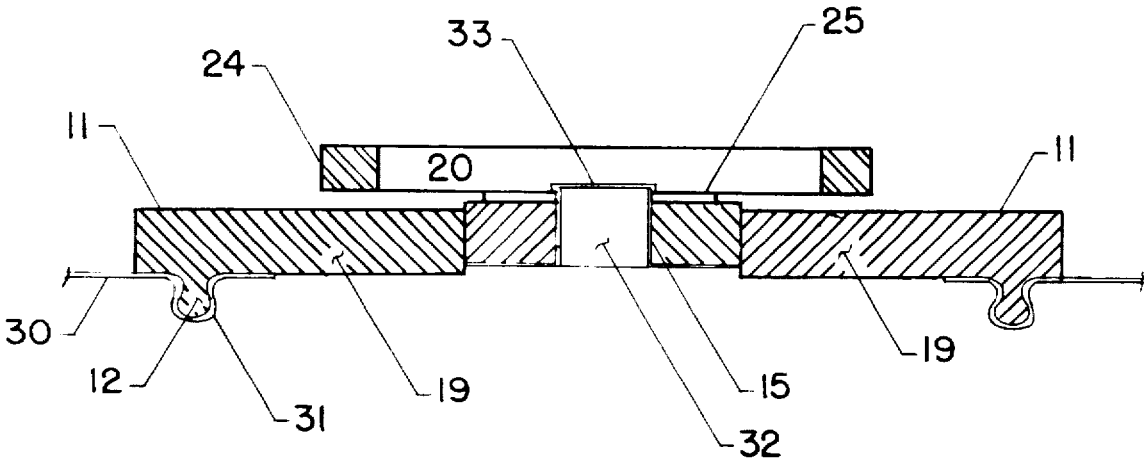
FIGS. 3A and 3B are enlarged sectional views depicting alternative embodiments of a closing tab and it's component parts, a metal opening tab, and a can end wall. The closing tab is shown in the can closing position taken along line 3—3 as shown in FIG. 2.
Figure 3B:
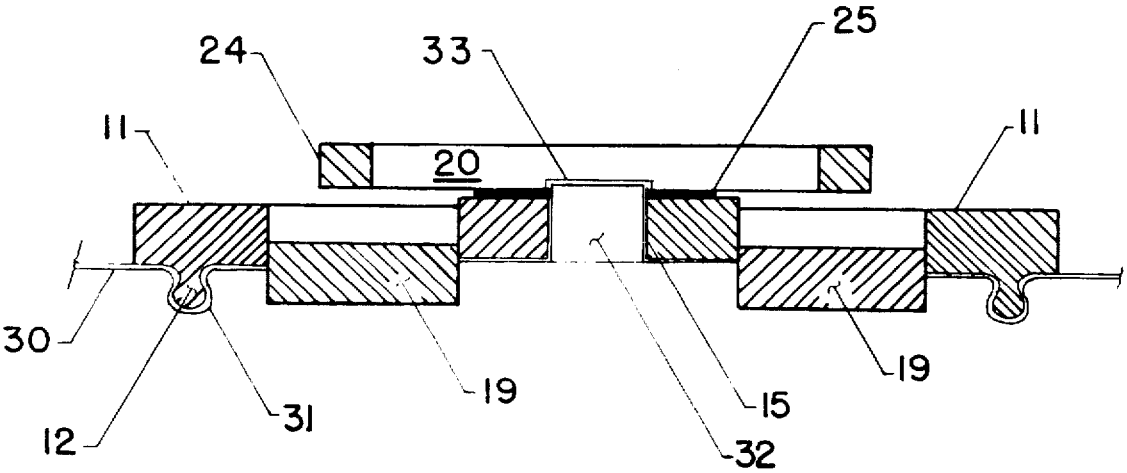

In a third alternative embodiment, semi-annular locking ring 14, beveled edge 16, and semi-annular locking channel 17 are omitted for the purposes of minimizing the manufacturing costs of closing tab 10 and providing for dual use of annular sealing ring 12 and annular sealing channel 31. The function of securely positioning and firmly holding closing tab 10 within the opening in can end wall 30 would be performed by annular sealing ring 12 modified in shape from the preferred embodiment so as to interlock, rather than mesh, with annular sealing channel 31 which also would be modified in shape to complement the shape of annular sealing ring 12. Thus, annular sealing ring 12 would snap into place in annular sealing channel 31 and perform the dual functions of sealing the opening in can end wall 30 and securely positioning and firmly holding closing tab 10 within the opening. This alternative embodiment is depicted in FIGS. 3A and 3B. The top surface of central body 19 can be either coincident with the top surface of circumferential flange 11, as shown in FIG. 3A, or displaced a predetermined distance below circumferential flange 11 as shown in FIG. 3B.

The thickness of closing tab 10 is not uniform. The thickness of closing tab 10 is reduced from it's full thickness at a reference point 10' (also shown in FIGS. 4 and 5), to a thickness equal to that of circumferential flange 11. This reduction takes place uniformly between reference point 10' ie. the open portion of the horse shoe shaped semi-annular locking ring 14, and the connection of closing tab 10 to attaching post/rivet 32. This reduction in thickness is required to reduce the biasing forces on closing tab 10 during manufacture, shipping, and storage which would cause closing tab 10 to flex upwards when in the shipping/can-opening position. This upward flexure would interfere with can stackability and could deform closing tab 10 such that it's ability to close the opening in can end wall 30 would be negatively impacted. This is more clearly shown in FIGS. 4 and 5 which depict sectional views of closing tab 10.

Closing tab 10 is attached to can end wall 30 by placing attaching post/rivet 32 into hole 15 of closing tab 10 and a hole in a semi-circular metal projection 25 of metal opening tab 20. Attaching post/rivet 32 is then deformed in a manner so as to create top flange 33 which secures both closing tab 10 and metal opening tab 20 in position and allows both to be independently rotated for opening and closing of can end wall 30.

FIG. 4 is a sectional view taken along line 4—4 shown in FIG. 1. It depicts closing tab 10 in the shipping/can-opening position. Closing tab 10 will be in this approximate position prior to purchase and use of the product contained in the can, as well as during dispensing of the product. Both closing tab 10 and metal opening tab 20 are secured to can end wall 30 by attaching post/rivet 32 and top flange 33.

FIG. 4 depicts a downward enlargement 23 of a side wall 24 on lever end 22 of metal opening tab 20. Downward enlargement 23 is fabricated from the same material as metal opening tab 20 and is an integral part of metal opening tab 20. Also shown are central body 19, circumferential flange 11, annular sealing ring 12, annular sealing channel 31, semi-annular locking ring 14, semi-annular locking channel 17, beveled edge 16, tab opening strip 18, and attaching post/rivet 32 and top flange 33. All component parts are connected as previously described. Opening panel 35, arcuate scoreline 36, and double seam joint 37 joining can end wall 30 to can body 38 also are depicted in FIG. 4 as well as a can bottom (portion) 40 of an identical can stacked on top of the shown can to demonstrate lack of interference of closing tab 10 with the stackability of the can.

FIG. 5 is a sectional view taken along line 5—5 as shown on FIG. 1. Closing tab 10 has been rotated approximately 180 degrees from the shipping/can-opening position shown in FIGS. 1 and 4. FIG. 5 depicts closing tab 10 in the can closing position with annular sealing ring 12 fully meshed with annular sealing channel 31 and held firmly in place by semi-annular locking ring 14 and semi-annular locking channel 17. The thickness of closing tab 10 transitions from it's full thickness to a thickness equal to circumferential flange 11 between reference point 10' and the attachment of closing tab 10 to attaching post/rivet 32. This transition is necessary to reduce the biasing forces on closing tab 10 which would cause it to flex upwards and not lie flat against can end wall 30 when closing tab 10 is in the shipping/can-opening position.

Tab opening strip 18 is located on the top and outward side of circumferential flange 11 of closing tab 10 to assist in removal of closing tab 10 from the opening in can end wall 30 used to dispense the contents of the can. In the first alternative embodiment, discussed previously, wherein circumferential flange 11 is omitted, tab opening strip 18 is located on the top and outward side of central body 19 of closing tab 10.

FIG. 5 also depicts downward enlargement 23 of side wall 24 on lever end 22 of metal opening tab 20. Downward enlargement 23 is fabricated from the same material as metal opening tab 20, and is an integral part of metal opening tab 20. The thickness of downward enlargement 23 is approximately equal to the thickness of circumferential flange 11.

Downward enlargement 23 is necessary to preserve the present can opening methodology employing metal opening tab 20 to rupture opening panel 35 along arcuate scoreline 36.

The preferred and alternative embodiments described above assume the continued use of can end wall 30 provided with arcuate scoreline 36 and opening panel 35 to seal material within can body 38. A fourth alternative embodiment of closing tab 10 would eliminate use of arcuate scoreline 36 and opening panel 35 in can end wall 30. In this alternative embodiment, closing tab 10 would be placed, at the time of can manufacture, within the opening presently defined by arcuate score line 36. Since opening panel 35 is eliminated in this embodiment, metal opening tab 20 also is eliminated as the sole function of metal opening tab 20 is to effectuate rupture of opening panel 35 along arcuate scoreline 36. In addition to being mounted within the opening in can end wall 30, closing tab 10 also would be rotationally attached to can end wall 30 at attaching post/rivet 32.

From the description above, a number of advantages of our closing tab become evident. They are listed below:

(a) The closing tab is very economical to produce using conventional injection molding equipment and can be fabricated from commonly available plastics compatible for use in food containers. The four alternative embodiments discussed above result in further manufacturing economies.

(b) Existing can construction and manufacture are minimally impacted.

(c) The closing tab is positively located and secured in the opening in the can end wall used to remove the contents of the can.

(d) Can stackability is not impacted.

OPERATION

FIGS. 1 and 4 depict closing tab 10 in the shipping/can-opening position. To open can end wall 30, the consumer pulls handle end 21 of metal opening tab 20 in an upward direction resulting in lever end 22 and downward enlargement 23 moving in a downward direction and coming in contact with, and exerting pressure on, opening panel 35. This pressure causes opening panel 35 to rupture along arcuate scoreline 36 forming an opening which allows the consumer to dispense the contents of can body 38. FIGS. 2, 3, 3A, 3B, and 5 depict closing tab 10 in the can closing position. To close the opening in can end wall 30, closing tab 10 is rotated approximately 180 degrees about attaching post/rivet 32. This rotation aligns closing tab 10 with the opening. Closing tab 10 is then pushed downwardly into the opening to close can end wall 30. Closing tab 10 is removed from the opening by grasping tab opening strip 18 between the thumb and index finger and pulling upwardly on tab opening strip 18.

When closing tab 10 is rotated approximately 180 degrees from the shipping/can-opening position to a location over the opening in can end wall 30 caused by the rupture of opening panel 35, and pushed downwardly into the opening, beveled edge 16 causes can end wall 30 to deflect downward. As closing tab 10 continues to be pushed downwardly into the opening, semi-annular locking ring 14 elastically deforms allowing it to pass completely through the opening in can end wall 30. Can end wall 30 in turn becomes aligned with semi-annular locking channel 17, and interlocks with semi-annular locking channel 17, ie. "snaps" into place. After can end wall 30 snaps into place, semi-annular locking ring 14 elastically returns to it's original shape, thus securely positioning and holding closing tab 10 in the opening in can end wall 30.

The first and second alternative embodiments, described previously, are operated in a like manner to that described above for the preferred embodiment. Also, the third alternative embodiment is operated in a like manner to the preferred embodiment with the exception that semi-annular locking ring 14 and semi-annular locking channel 17 are omitted. Their function of securely positioning and holding closing tab 10 within the opening in can end wall 30 is performed by annular sealing ring 12 and annular sealing channel 31. The fourth alternative embodiment, wherein closing tab 10 is used in lieu of opening panel 35, is operated in a different manner than that described above for the preferred embodiment. As the fourth embodiment eliminates opening panel 35, as well as the use of metal opening tab 20, to effectuate rupture of opening panel 35, the consumer would simply remove closing tab 10 from the opening in can end wall 30 by pulling tab opening strip 18 in an upward direction. Closing tab 10 would be rotated away from the opening to dispense the material contained within the can. To close can end wall 30, closing tab 10 would be rotated to a position over the opening and pushed in a downward direction, as described above.

From the above operation description, a number of advantages of our closing tab become evident:

(a) The closing tab is extremely simple and convenient to use and does not require the consumer to dispose, wash, handle, or store a second piece of material which is either separate from, or must be detached from the can.

(b) In the preferred embodiment, as well as the first, second, and third alternative embodiments, use of the metal opening tab for rupturing the opening panel eliminates the direct digital pressure required by the prior art to rupture the opening panel. Also no part of the users' fingers will come in contact with the contents of the can or any sharp edges as a result of using the closing tab described above. In the fourth alternative embodiment, the opening panel and metal opening tab are eliminated, thus further simplifying operation of the closing tab.

SUMMARY, RAMIFICATIONS, AND SCOPE

Accordingly, the reader will see that the closing tab of this invention is economical to produce, minimally impacts existing can construction and manufacturing techniques and methods, and is simple, convenient, and safe to use.

Although the description above contains many specificities, these should not be construed as limiting the scope of the invention but as merely providing illustrations of some of the presently preferred embodiments of this invention. For example, the closing tab can have other shapes such as trapezoidal, triangular, circular, etc., be a different thickness, or be manufactured without one or more of it's component parts as previously described in the discussions of alternartive embodiments. Also the closing tab can be used to close containers other than those used by the beverage industry. For example, the closing tab could be adapted for use on any container holding a material which is not completely consummed in a single use.

Thus the scope of the invention should be determined by the appended claims and their legal equivalents, rather than by the examples given.

Having thus described our invention, we claim:

1. An improved can closure comprising:

a) a can end wall joined to a can body and further comprising an arcuate scoreline which defines an opening panel, an attachment means for rotationally joining a metal opening tab and a closing tab to said can end wall, and an opening having predetermined size and shape resulting from the rupture of said opening panel along said arcuate scoreline;

b) said metal opening tab being substantially parallel to said can end wall and further comprising a downward enlargement of a side wall on a lever end of said metal opening tab;

c) said closing tab being manufactured from a rigid elastically deformable material and further comprising a central body of predetermined size and shape to include a hole for rotationally joining said closing tab to said can end wall and corresponding in size and shape to said opening in said can end wall, and positioned between said can end wall, and said metal opening tab;

d) said closing tab further comprising a circumferential flange projecting outwardly from said central body of said closing tab, said circumferential flange being integral with said closing tab and of sufficient size and shape to prevent said closing tab from completely passing through said opening;

e) said circumferential flange including an annular sealing ring projecting downwardly from said circumferential flange; and f) said can end wall further comprising an annular sealing channel provided in said can end wall.

2. The improved can closure of claim 1, wherein said annular sealing ring is of predetermined size and shape so as to mesh with said annular sealing channel.

3. The improved can closure of claim 1 wherein said annular sealing ring is of predetermined size and shape, and adapted to deformably pass into said annular sealing channel and elastically return to said predetermined size and shape inorder to interlock with said annular sealing channel to secure said closing tab firmly in place within said opening.

4. The improved can closure of claim 1, further including a tab opening strip projecting upwardly from the top and outward side of said circumferential flange for removing said closing tab from said opening.

5. The improved can closure of claim 1 wherein said attachment means for rotationally joining said metal opening tab and said closing tab to said can end wall further comprises an attaching post/rivet and a top flange.

6. An improved can closure comprising:

a) a can end wall joined to a can body, said can end wall having an opening of sufficient size to dispense material contained within said can body, and an attachment means for rotationally joining a closing tab to said can end wall; wherein b) said closing tab being manufactured from a rigid elastically deformable material and further comprising a central body of predetermined size and shape to include a hole for rotationally joining said closing tab to said can end wall and corresponding in size and shape to said opening in said can end wall, and positioned within said opening in said can end wall;

c) said closing tab further comprising a circumferential flange projecting outwardly from said central body of said closing tab, said circumferential flange being integral with said closing tab and of sufficient size and shape to prevent said closing tab from completely passing through said opening;

d) said circumferential flange further including an annular sealing ring projecting downwardly from said circumferential flange; and e) said can end wall further comprising an annular sealing channel provided in said can end wall.

7. The improved can closure of claim 6, wherein said annular sealing ring is of predetermined size and shape so as to mesh with said annular sealing channel.

8. The improved can closure of claim 6, wherein said annular sealing ring is of predetermined size and shape, and adapted to deformably pass into said annular sealing channel and elastically return to said predetermined size and shape inorder to interlock with said annular sealing channel to secure said closing tab firmly in place within said opening.

9. The improved can closure of claim 6, further including a tab opening strip projecting upwardly from the top and outward side of said circumferential flange for removing said closing tab from said opening.

10. The improved can closure of claim 6 wherein said attachment means for rotationally joining said closing tab to said can end wall further comprises an attaching post/rivet and a top flange.

* * * * *